United States Patent [19]

Melilli

[11] 4,135,747

[45] Jan. 23, 1979

[54] FENCE GATE LATCH

[76] Inventor: Gennarino Melilli, 17204 Marigold, Fontana, Calif. 92335

[21] Appl. No.: 810,870

[22] Filed: Jun. 28, 1977

[51] Int. Cl.[2] ..... E05C 1/04

[52] U.S. Cl. ..... 292/175

[58] Field of Search ..... 292/207, 175, 302, 171, 292/148

[56] References Cited

U.S. PATENT DOCUMENTS

| | | | |
|---|---|---|---|
| 1,262,054 | 4/1918 | Johnson et al. | 292/302 X |
| 2,482,341 | 9/1949 | Holmsten | 292/148 |
| 2,758,864 | 8/1956 | Dixon | 292/302 |
| 2,821,423 | 1/1958 | Petersen | 292/148 |

FOREIGN PATENT DOCUMENTS

| | | | |
|---|---|---|---|
| 754353 | 8/1933 | France | 292/302 |

*Primary Examiner*—Richard E. Moore

[57] ABSTRACT

A fence gate latch for rolling or swinging gates having a yoke for receiving a gate stile, and a spring loaded and beveled latch bolt for retaining the gate stile in the yoke. Means are provided for retracting the latch bolt from either side of the fence.

3 Claims, 7 Drawing Figures

Fig. 4
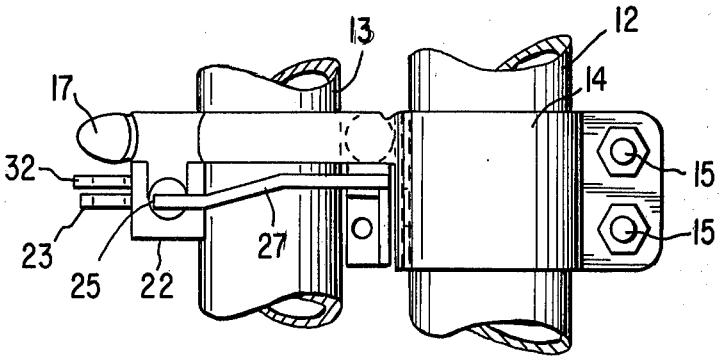
Fig. 5
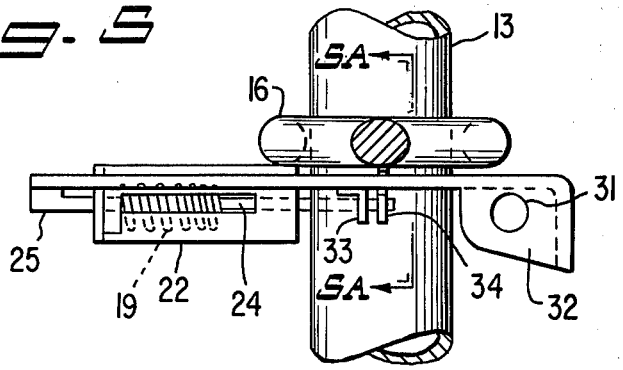
Fig. 6
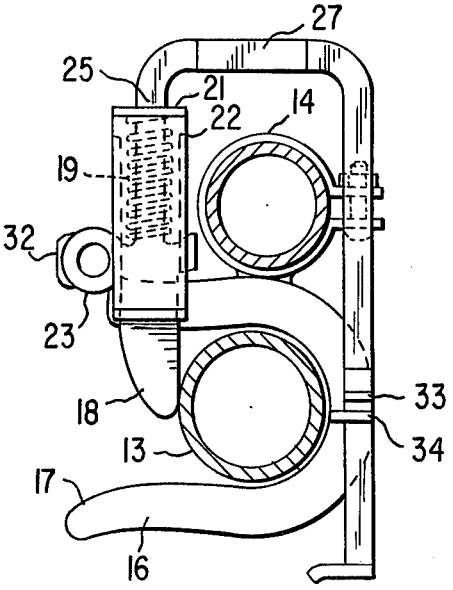
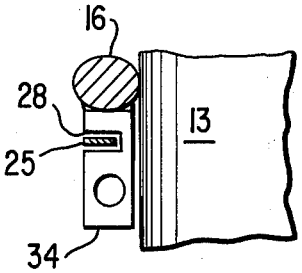
Fig. 5A

FENCE GATE LATCH

BACKGROUND OF THE INVENTION

1. Field of the Invention

This invention relates to latches and more particularly to latches for latching fence gates.

2. Prior Art

The art of latching gates is, of course, very old, going back to biblical times. As the art developed, however, the latches devised by workers in the art were particularly adaptable to swinging gates and no good latch has been developed which could be utilized with rolling gates. The invented gate latch can not only be used with rolling gates, but is useful to latch swinging gates as well.

It is an object of the present invention to provide a fence gate latch which can be conveniently and economically manufactured to be used with rolling gates.

It is also an object of the present invention to provide a fence gate latch for either rolling or swinging gates.

SUMMARY OF THE INVENTION

Rolling gates are extensively used industrially since it is often not convenient to provide the space or structure necessary to swing gates of the sizes used in industrial applications. A common type of fence and gate used is a so called chain link type which utilizes steel tubing for the fence posts and gate stiles.

Since latches for rolling gates are not commercially available, most users simply lock their gates using a piece of chain threaded through the fence and around the gate stile and a fence post.

The present invention includes a yoke which is attached to a fence post and in which a gate stile may be retained by a spring driven latch bolt. A stem on the rear of the latch bolt forms a handle for retracting the latch bolt from one side of the gate and is bent so as to extend to the other side of the fence so that the gate can be unlatched therefrom.

BRIEF DESCRIPTION OF THE DRAWINGS

FIG. 4 is a side elevation of the embodiment of FIG. 2 in the direction 4—4 of FIG. 2.

FIG. 5 is a side elevation of the embodiment of FIG. 2 in the direction 5—5 of FIG. 2.

FIG. 5A is an enlarged detail of a portion of FIG. 5 taken at 5A—5A of FIG. 5.

FIG. 6 is a plan view of a second embodiment of the invention.

DETAILED DESCRIPTION OF THE PREFERRED EMBODIMENTS

Figure 1:
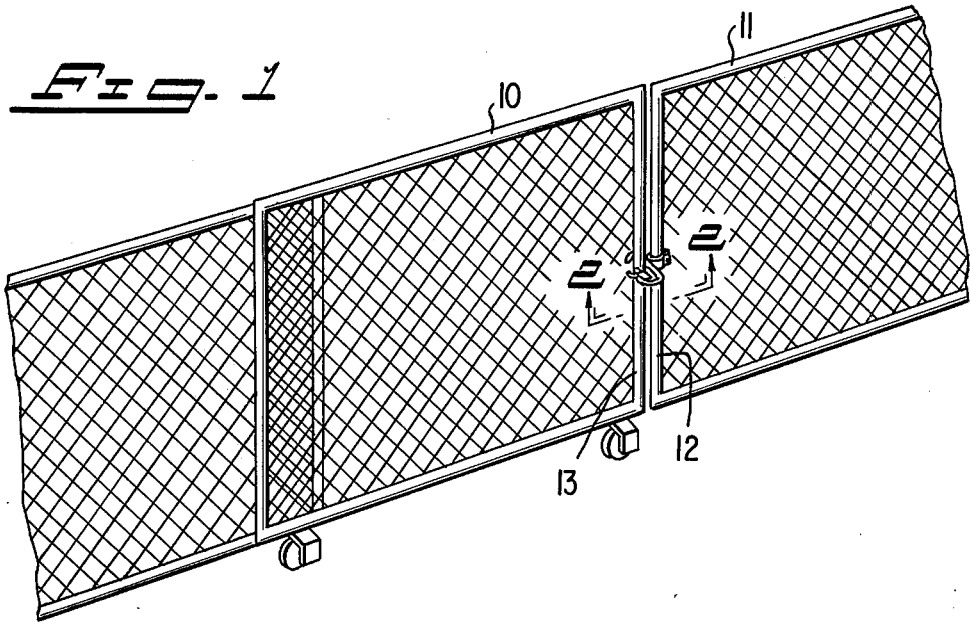
FIG. 1 is a perspective view of the present invention installed on a chain link fence with a rolling gate.
Figure 3:
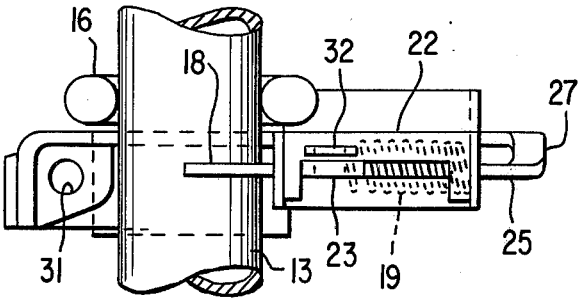
FIG. 3 is a side elevation of the embodiment of FIG. 2 in the direction 3—3 of FIG. 2.
Figure 2:
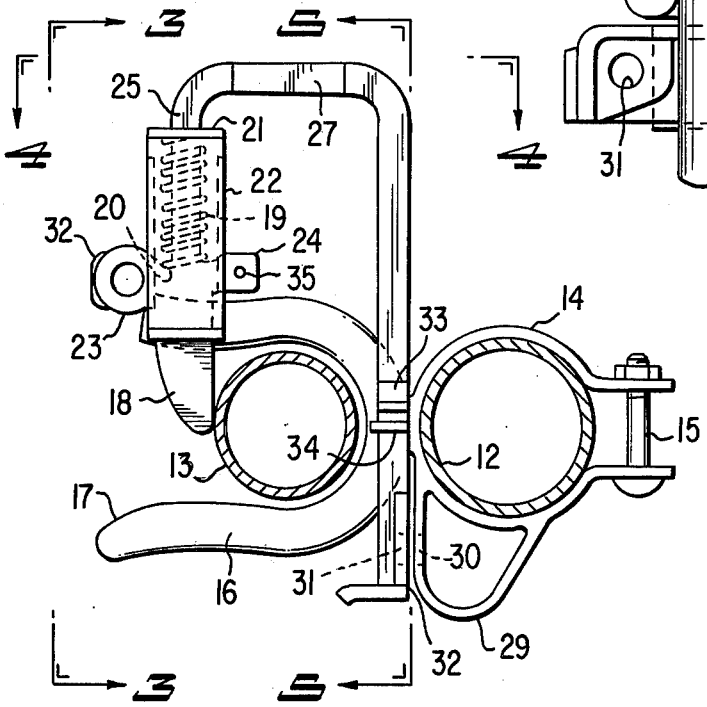
FIG. 2 is a bottom view of a presently preferred embodiment of the invented fence gate latch.

The present invention is shown in FIG. 1 as applied to a rolling gate wherein the gate 10 is latched to fence 11. The mechanism may be seen most clearly in the plan view of FIG. 2 where it can be seen that the stationary portion of the latch is clamped to fence post 12 by clamp 14 and bolts 15. The gate stile 13 is retained in yoke 16, which may have a slightly flared entry 17 to assure ease of operation. Latch bolt 18 retains stile 13 in the yoke and prevents the gate from being opened until the latch is retracted. Latch bolt 18 is urged to its extended position as shown in FIG. 2 by spring 19 which bears on shoulder 20 of latch bolt 18 and on the rear wall 21 of spring housing 22.

A pair of ears 23 and 24 attached to the latch bolt 18 extend through guide slots in the side of spring retainer 22 providing extra stability for the latch bolt and a convenient place for attaching a padlock and power assist devices, as will be discussed below. Stem 25 passes through the center of spring 19 and out through a slot in rear wall 21. The direction of motion of latch bolt 18 is substantially normal to the axis of yoke 16 and the latch is beveled on one side so that gate stile 13 will push it out of the way as the gate travels toward its closed position, but once the gate is closed, the latch bolt must be manually retracted before the gate can be opened. In its extended position, the end of the latch bolt is preferably slightly beyond the center of the yoke so as to assure retention of the gate stile, but not so far as to require excessive motion of the latch in order to open the gate.

Stem 25 is bent at right angles to the direction of emergence from housing 22 to provide a convenient handle 27 for retracting the latch bolt. A second right angle bend in the stem 25 allows it to be extended through the space between fence post 12 and gate stile 13 so that latch bolt retraction can be effected from the other side of the fence, if desired. The stem 25 passes through slot 28 in ear 34, which imparts additional stability to the stem at the opening between the fence and the gate.

Three convenient positions for padlocking the gate latch are shown. Any one or all may be used as desired. An ear 29 may be attached to clamp 14 and provided with a hole 30 to align with a similar hole 31 in flange 32 on the extended portion of stem 25. A padlock through holes 30 and 31 effectively prevents retraction of latch bolt 18.

Similarly, an ear 32 is attached to spring housing 22 adjacent to ear 23 can be provided with a hole which cooperates with a mating hole in ear 23 to accept a padlock.

A third location for a padlock is in the space between the fence post and gate stile. This position makes the lock equally accessible from either side of the fence, in cases where this is desirable. Flanges 33 and 34 attached to stem 25 and yoke 16 respectively carry holes through which a lock may be placed.

As an additional convenience, ear 24 is shown provided with a hole 35 which may be used in conjunction with a power operated latch retractor, when an automatic gate opening system is used.

The preferred embodiment of the invented gate latch is shown with the fence and gate in alignment. However, it is sometimes preferred to have the gate offset in order to allow the fence portions on either side of the gate to be in alignment. To provide for such cases, the clamp 14 may be attached to yoke 16 in the position shown in FIG. 6. The gate track is then adjacent to the fence proper, instead of being in line with it and the two portions of the fence are on a line.

While the embodiment of FIG. 2 may be used with swinging as well as rolling gates, the embodiment of FIG. 6 will allow the gate and fence to be in alignment when used with swinging gates. The difference between the embodiments of FIGS. 2 and 6 is simply the position of clamp 14 with respect to yoke 16. The open portion of clamp 14 can, of course, be fabricated in any position with respect to the clamp as required so that the bolts 15 will extend through the fence and the nuts thereon be inaccessible from outside the enclosure.

What has been described is a novel and useful fence gate latch. Various modifications will be apparent to those skilled in the art and are considered to be within the spirit of the invention as set forth in the appended claims.

I claim:

1. A latch for a fence gate of the type having a tubular frame which comprises:

(a) a "U" shaped yoke for receiving a tubular gate stile;

(b) means for attaching said yoke to a fence post whereby the plane of said "U" is substantially horizontal;

(c) a latch bolt slideable to at least partially close the opening of said yoke, said latch bolt having a beveled portion directed outward of said yoke whereby said gate stile can displace said latch bolt and enter said yoke;

(d) a coil spring urging said latch bolt to its closed position; and (e) a stem attached to the rear of said latch bolt and extending through said spring, the portion of said stem remote from said latch bolt being graspable to retract said latch bolt.

2. A fence gate latch as recited in claim 1 where said stem is extended to pass between the gate stile and fence post when said gate is in the closed position whereby said latch bolt is retractable from either side of said fence.

3. A fence gate latch as recited in claim 1 and further including:

(a) a first ear attached to said stem having a hole for a padlock therein; and (b) a second ear attached to said yoke adjacent said first ear, said second ear having a hole therein for a padlock whereby said latchbolt can be locked to prevent retraction.

* * * * *